US005458172A

United States Patent [19]

Rautio

[11] Patent Number: 5,458,172

[45] Date of Patent: Oct. 17, 1995

[54] DEBARKING AND CHIPPING APPARATUS

[76] Inventor: Kauko Rautio, Kyttäläntie 1, FIN-52700 Mäntyharju, Finland

[21] Appl. No.: 261,610

[22] Filed: Jun. 17, 1994

[51] Int. Cl.[6] ..... B27L 1/00

[52] U.S. Cl. ..... 144/208 F; 144/208 R; 144/162 R; 144/218; 144/246 C; 144/246 E; 144/249 A; 144/341; 144/373; 144/3 R

[58] Field of Search ..... 144/3 R, 114 R, 144/117 R, 162 R, 172, 174, 208 R, 218, 242 R, 246 R, 246 C, 246 E, 249 R, 249 A, 341, 373, 375, 208 F

[56] References Cited

U.S. PATENT DOCUMENTS

| | | | |
|---|---|---|---|
| 3,963,064 | 6/1976 | Hayes . | |
| 4,102,369 | 7/1978 | Rautio | 144/208 R |
| 4,875,511 | 10/1989 | Wingate-Hill et al. | 144/208 R |
| 4,889,169 | 12/1989 | Peterson et al. | 144/370 |
| 4,898,221 | 2/1990 | Eriksson | 144/208 E |
| 5,111,860 | 5/1992 | Wingate-Hill et al. | 144/208 R |
| 5,297,601 | 3/1994 | Munsey et al. | 144/208 F |

FOREIGN PATENT DOCUMENTS

| | | |
|---|---|---|
| 26108 | 11/1953 | Finland . |

*Primary Examiner*—W. Donald Bray
*Attorney, Agent, or Firm*—Pennie & Edmonds

[57] ABSTRACT

A debarking and chipping apparatus mainly for coniferous trees, intended for the production and recovery of bark chips and chips for digestion from small trees (5) having a diameter of 4–20 cm. The apparatus is made up of a debarking unit (1), which debarks and cuts the bark into bark chips, and the debarking unit is followed by a chipper (2) which turns the heartwood (16) into chips for digestion.

11 Claims, 4 Drawing Sheets

DEBARKING AND CHIPPING APPARATUS

FIELD OF THE INVENTION

The present invention relates to a debarking and chipping apparatus, mainly for coniferous trees, which apparatus is intended for the production and recovery of bark chips and of chips for digestion from small trees having a diameter of approximately 4–20 cm.

BACKGROUND OF THE INVENTION

In forest clearance, small trees are usually left to rot in the forest, since the use of small trees, for example industrially, is very cumbersome. The object of the invention is to provide an apparatus of a new type, by means of which small trees which have previously been left in the forests can be utilized industrially. The debarking and chipping apparatus according to the invention is characterized in that the apparatus is made up of a debarking unit which debarks the tree and chips the bark, the debarking unit being followed by a chipper which turns the heartwood into chips for digestion. By means of the invention, small trees are thus utilized one hundred percent, since the bark chips are used for fuel and the digestible chips for the production of pulp. The debarking and chipping rate of the debarking and chipping apparatus being, for example, 150 m/min, it can be calculated roughly that approximately 150 $m^3$ of digestible chips and approximately 60 $m^3$ of bark chips are obtained in one day. If the apparatus is in operation 24 hours a day, these figures can be multiplied by three. The rate can, of course be considerably higher than that in the said example.

SUMMARY OF THE INVENTION

One embodiment of the invention is characterized in that the debarking unit is made up debarking cutters in connection with which there is a support blade which grinds the bark and at the same time leans against the tree surface, thus allowing the debarking cutters to cut the bark and a predetermined amount of the sapwood. Since chips for digestion may contain bark at maximum 1%, the debarking cutters cut the tree surface to such an extent that a clean heartwood bole is obtained for chips for digestion. The fuel value of the bark chips is better if it also contains some wood.

Another embodiment of the invention is characterized in that the debarking cutter is made up of two cutter blades mounted on one and the same arbor at a blunt angle, e.g. $\alpha=135°$, to each other, with a support blade between them. When four evenly distributed debarking cutters are used, a debarked heartwood bole is obtained which has, for example, an octagonal cross sectional shape. Thus the quantity of digestible chips ending up in bark chips is not unnecessarily high. There may also be only two cutters, or more than two or four.

One embodiment of the invention is further characterized in that the arbor of the debarking cutter is telescopic so that the debarking cutter can move in the axial direction according to the shape of the tree. The debarking cutter will thus follow gently the shape of even a warped tree and will not leave bark on the surface.

One embodiment of the invention is characterized in that the debarking unit with its motor is mounted on a pivot axle in such a manner that the entire debarking unit can move around this axle according to the shape of the tree. The debarking cutter will thus follow the shape of a warped tree in directions transverse to the tree.

One embodiment of the invention is characterized in that the debarking unit with its motor is mounted to the apparatus frame by lever transmission in such a manner that the debarking unit is able to move about the mounting axle and in the direction of the arbor of the debarking cutter. This is one embodiment which additionally allows movements of the debarking cutter in directions transverse to the tree.

One embodiment of the invention is further characterized in that the pressing movements of the debarking cutters and the attenuations of the follow movements are produced by means of pressure cylinders known per se. Since the couplings and functions of the pressure cylinders constitute technology known per se, separate coupling diagrams are not presented for them.

One embodiment of the invention is characterized in that in connection with the debarking cutter there is a guide trough which guides the debarking cutter according to the shape of the tree. The guide trough drags along the tree surface and thus guides the movements of the debarking cutter in the direction of the arbor of the cutter, following the center line of the tree in accordance with the shape of the tree. The guide trough may be spring- or cylinder-loaded relative to the debarking cutter, in such a manner that it yields if there are branch stubs on the tree surface or when barks of different thicknesses are worked on.

One embodiment of the invention is further characterized in that in connection with the chipper there is a dividing unit which separates the chips containing bark chips from pure digestible chips. Thus the bark chips for fuel can be immediately separated from the chips going to the pulp industry. The position of the pivoting flap can be regulated by the distance of the feed rolls from each other. For example, if the distance between the rolls is less than 40 mm, the flap will direct the chips into bark chips.

BRIEF DESCRIPTION OF THE DRAWINGS

The invention is described below with the help of an example, with reference to the accompanying drawings, in which.

DETAILED DESCRIPTION OF THE INVENTION

Figure 2:
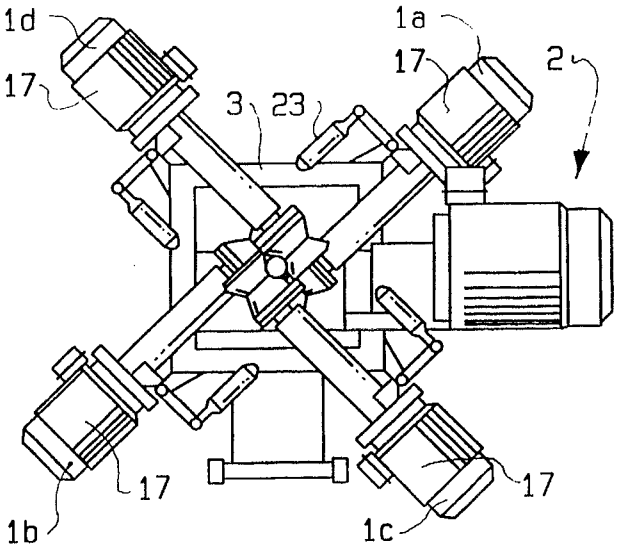
FIG. 2 depicts the apparatus as seen from the feed direction.
Figure 1:
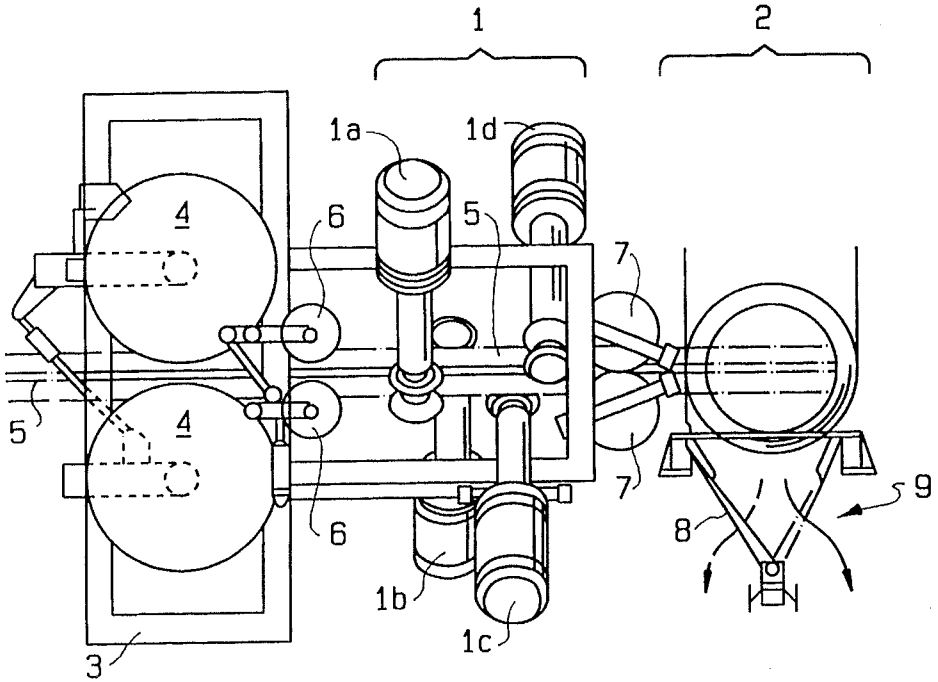
FIG. 1 depicts a side view of the debarking and chipping apparatus.
Figure 3:
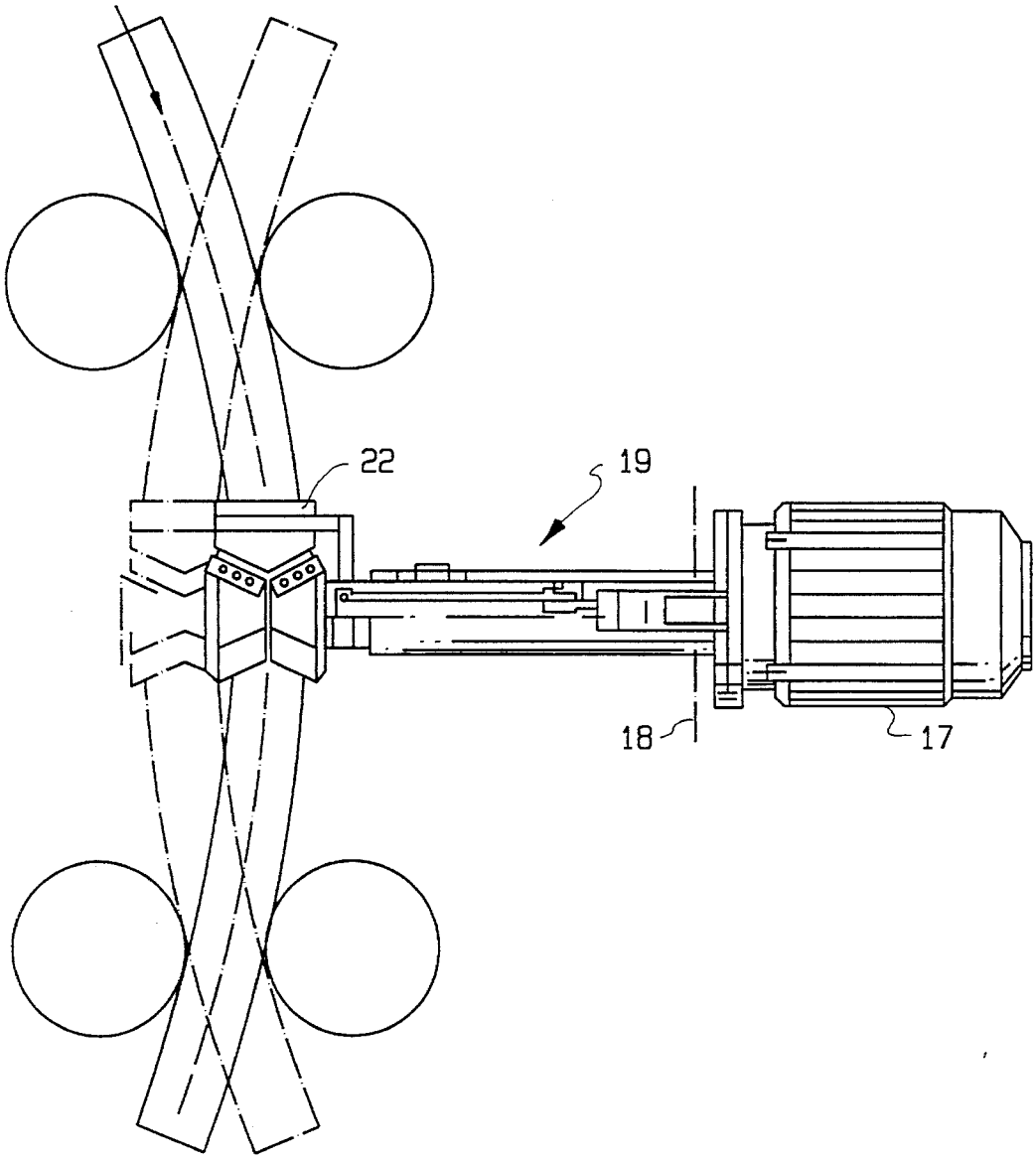
FIGS. 3 and 4 depict a telescopic arbor of the debarking cutter.
Figure 4:
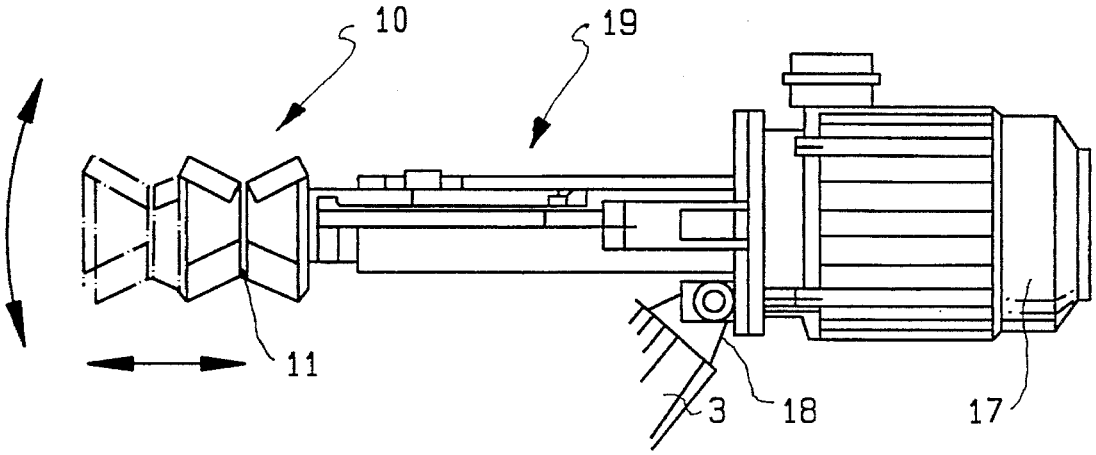
Figure 5:
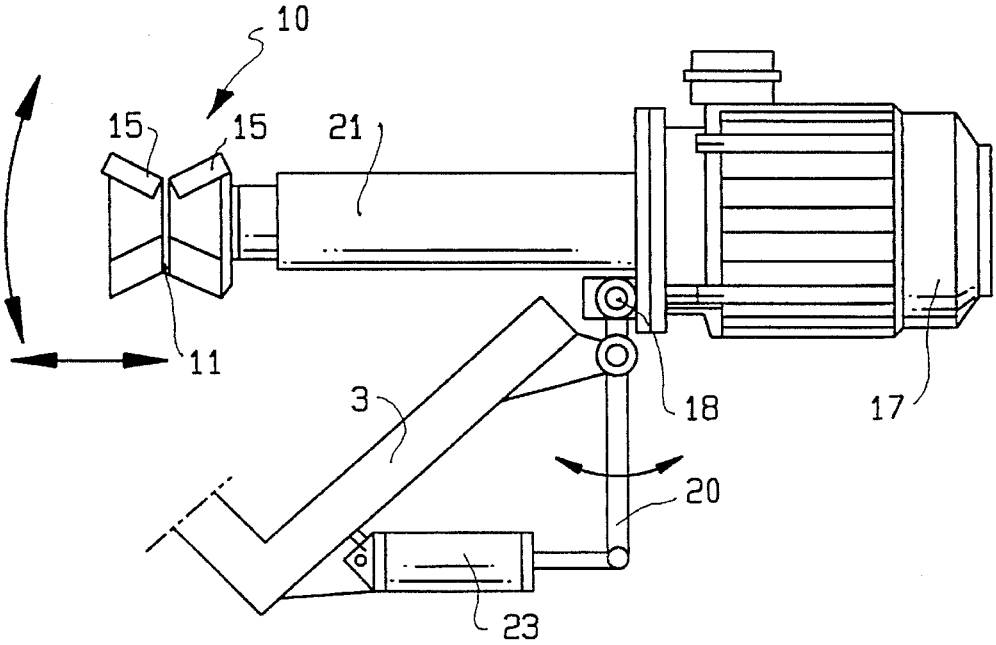
FIG. 5 depicts an articulated mounting of the debarking cutter.
Figure 6:
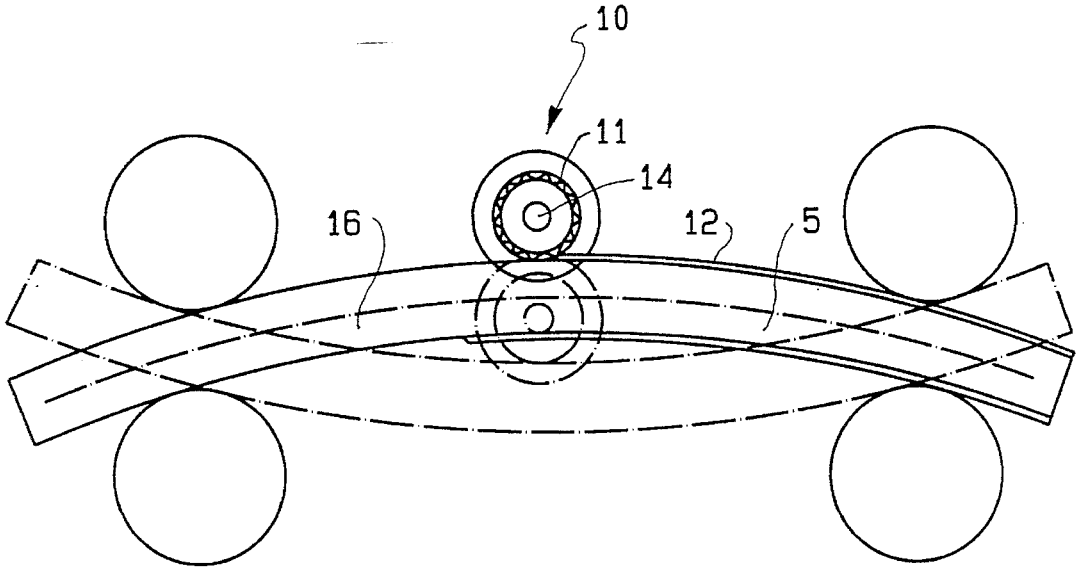
FIG. 6 depicts the guiding of a curved tree and the cutting by one cutter.
Figure 7:
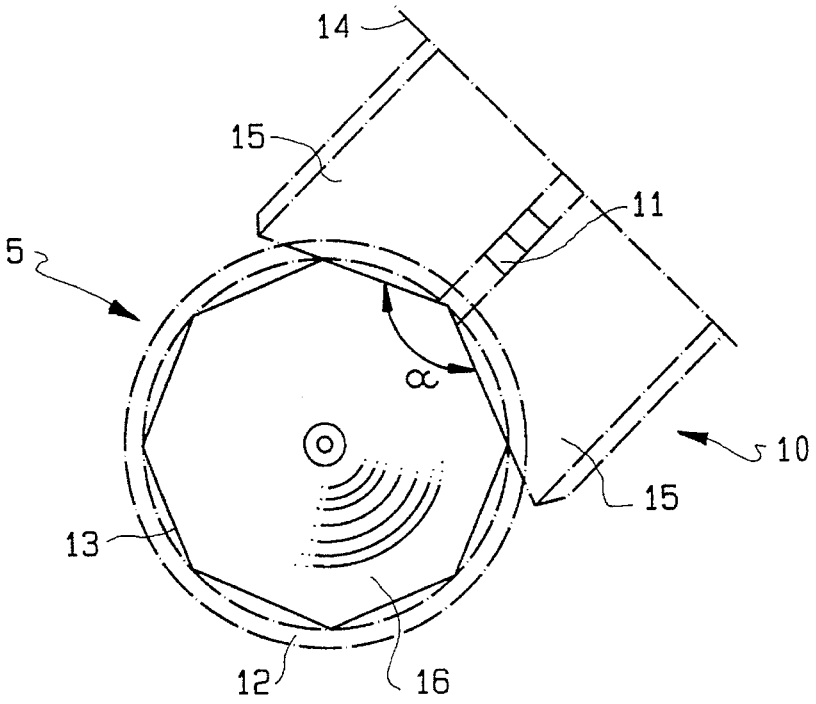
FIG. 7 depicts debarked heartwood in cross section.

The debarking and chipping apparatus is made up of a debarking unit 1, which debarks and cuts the bark into bark chips. The debarking unit 1 is followed by a chipper 2, which produces chips for digestion from the heartwood. To the frame 3 of the debarking and chipping apparatus there are attached feeder rolls 4, which feed a bole 5 between guide rolls 6 into the debarking unit 1. Between the debarking unit 1 and the chipper 2 there is another set of feeder rolls 7. In connection with the chipper 2 there is a dividing unit 9 operated by means of a pivoting flap 8, which separates chips containing bark chips from pure digestible chips in the manner indicated by arrows. The debarking unit 1 is made up of four debarking cutters 10, in connection with which there is a support blade 11, which grinds the bark and at the same time leans against the tree 5 surface and thus allows the debarking cutters to cut off the bark 12 and a predetermined amount of the tree surface 13. The debarking cutter 10 is made up of two cutter blades 15 which are mounted on the same arbor 14 at a blunt angle $\alpha=135°$ to each other, there being a support blade 11 between them. The debarking cutters 10 are mounted so that the debarked heartwood 16 will be octagonal in cross section, as shown in FIG. 7. The debarking unit with its motor 17 is mounted on a pivot axle 18 in such a manner that an entire debarking unit 1*a*, 1*b*, 1*c*, 1*d* can move around this axle according to the shape of the tree. In the embodiment according to FIGS. 3 and 4, the turning arbor 19 of a debarking cutter is telescopic in such a manner that the debarking cutter can move in the direction of this arbor according to the shape of the tree. In the embodiment according to FIGS. 2 and 5 the debarking unit with its motor 17 is mounted to the apparatus frame 3 by lever transmission 20 so that the debarking unit can move around the mounting axle 18 in the direction of the arbor 21 of the debarking cutter. In connection with the debarking cutter 10 there is a guide trough 22, which guides the debarking cutter 10 according to the shape of the tree.

It is clear for an expert in the art that the invention is not limited to the example presented above; it may vary within the scope of the accompanying claims. The pressure cylinders belonging to the apparatus and the functions of the cylinders have thus not been described in greater detail, since their couplings and functions constitute state-of-the-art technology. The working speed may vary. The number of cutters may be greater or smaller than four. The movements of the cutter may also be on other arms, in which case they will be somewhat different from those in the examples described above, but for working, there are actually needed only a movement parallel to the cutter radius, this movement being directed by the support blade/spring force, and a movement in the direction of the cutter arbor, this movement being directed by a spring-loaded guide trough, which is fixed in the direction of the cutter arbor and movable in the transverse direction. The flap guiding the chips may also be controlled automatically to pivot according to the thickness of the tree being worked on and/or, for example, by camera monitoring. The cutter blade angle may vary. The cutter blades may also be curved.

I claim:

1. A debarking and chipping apparatus for coniferous trees, intended for the production and recovery of bark chips and digestible chips from small trees (5) having a diameter of 4–20 cm, said apparatus comprising means for feeding the tree linearly through said apparatus, a debarking unit (1), which first debarks the bark (12) from the heartwood (16) of the tree and cuts the bark (12) into bark chips; and a chipper (2) which thereafter cuts the heartwood (16) into chips for digestion; said debarking unit (1) includes a plurality of debarking cutter units (1*a*, 1*b*, 1*c*, 1*d*) each of which cutter units includes a pair of rotating debarking cutters (10) rotatable about a common axis and axially spaced from each other along said axis, and a support blade (11) positioned axially between said cutters (10), said support blade (11) bearing against the tree and grinding off the bark (12) and the debarking cutters (10) cutting off bark (12) and a predetermined amount of said heartwood (16).

2. A debarking and chipping apparatus to claim 1, characterized in that said debarking cutters 10 include two cutter blades (15) mounted on a single arbor (14) at a blunt angle, of about 135° , to each other.

3. A debarking and chipping apparatus according to claim 2, characterized in that the debarking cutter units (1*a*, 1*b*, 1*c*, 1*d*) are four in number, and are mounted so that the debarked heartwood (16) will be substantially octagonal in its cross section.

4. A debarking and chipping apparatus for coniferous trees, intended for the production and recovery of bark chips and digestible chips from small trees (5) having a diameter of 4–20 cm, characterized in that the apparatus comprises means for feeding the tree linearly through said apparatus, a debarking unit (1), which first debarks the bark (12) from the heartwood (16) of the tree and cuts the bark (12) into bark chips; and a chipper (2) which thereafter cuts the heartwood (16) into chips for digestion; said debarking unit (1) including a plurality of debarking cutter units 1*a*, 1*b*, 1*c*, 1*d*) each of which is mounted on an arbor (19), which arbor (19) is telescopic so that each debarking cutter unit (1*a*, 1*b*, 1*c*, 1*d*) can move in the direction of the arbor on which it is mounted according to the shape of the tree.

5. A debarking and chipping apparatus for coniferous trees, intended for the production and recovery of bark chips and digestible chips from small trees (5) having a diameter of 4–20 cm, characterized in that the apparatus comprises means for feeding the tree linearly through said apparatus, a debarking unit (1), which first debarks the bark (12) from the heartwood (16) of the tree and cuts the bark (12) into bark chips, and a chipper (2) which thereafter cuts the heartwood (16) into chips for digestion; said debarking unit (1) including a plurality of debarking cutter units (1*a*, 1*b*, 1*c*, 1*d*) and a motor (17) for each cutter unit for operating said cutter unit, each of said cutter units being mounted on a pivot axle (18) so that the entire cutter unit can move about said pivot axle according to the shape of the tree.

6. A debarking and chipping apparatus according to claim 5, characterized in that each debarking cutter unit (1*a*, 1*b*, 1*c*, 1*d*) with its motor (17) is mounted on a turning arbor (21), which arbor is mounted to an apparatus frame (3) by lever transmission (20) so that each debarking cutter unit can move around said pivot axle (18) and in the direction of the turning arbor (21) of the debarking cutter units.

7. A debarking and chipping apparatus according to claim 6, characterized in that the apparatus further includes pressure cylinders (23) for producing pressing movements of the debarking cutters (10) and attenuations of their follow movements.

8. A debarking and chipping apparatus according to claim 1, characterized in that each debarking cutter unit (1*a*, 1*b*, 1*c*, 1*d*) includes a guide trough (22) which guides the debarking cutter unit according to the shape of the tree.

9. A debarking and chipping apparatus according to claim 1, characterized in that the chipping apparatus (2) includes a dividing unit (9) operating by means of a pivoting flap (8), the dividing unit separating the chips containing bark chips from pure digestible chips.

10. A debarking and chipping apparatus according to claim 5 or 1 characterized in that each of said debarking cutter units (1*a*, 1*b*, 1*c*, 1*d*) is mounted on an arbor (19), which arbor is telescopic so that each debarking cutter unit can move in the direction of the arbor on which it is mounted according to the shape of the tree.

11. A debarking and chipping apparatus according to claim 4 or 1 characterized in that each of the debarking cutter units (1*a*, 1*b*, 1*c*, 1*d*) includes a motor (17) for operating said cutter unit, and each of said cutter units is mounted on a pivot axle (18) so that the entire cutter unit can move about said pivot axle according to the shape of the tree.

* * * * *